United States Patent [19]

Weingart

[11] Patent Number: 4,888,522

[45] Date of Patent: Dec. 19, 1989

[54] ELECTRICAL METHOD AND APPARATUS FOR IMPELLING THE EXTRUDED EJECTION OF HIGH-VELOCITY MATERIAL JETS

[75] Inventor: Richard C. Weingart, Livermore, Calif.

[73] Assignee: The United States of America as represented by the Department of Energy, Washington, D.C.

[21] Appl. No.: 186,992

[22] Filed: Apr. 27, 1988

[51] Int. Cl.[4] ..... H01J 7/26; H05H 5/00

[52] U.S. Cl. ..... 315/111.61; 315/111.01; 328/233; 250/423 R

[58] Field of Search ..... 315/111.61, 111.81, 315/111.91, 111.01, 111.41, 111.21, 5.41, 39; 313/231.31, 231.41, 359.1, 361.1, 362.1; 376/127, 128; 328/233; 250/423 R

[56] References Cited

U.S. PATENT DOCUMENTS

| | | | |
|---|---|---|---|
| 3,020,431 | 2/1962 | Mortina | 315/111.01 X |
| 3,151,259 | 9/1964 | Gloersen et al. | 328/233 |
| 3,226,592 | 12/1965 | Gough et al. | 315/111.6 X |
| 3,256,687 | 6/1966 | Jones et al. | 60/202 |
| 3,579,028 | 5/1971 | Paine et al. | 313/155 X |
| 3,854,097 | 12/1974 | Fletcher et al. | 328/233 |
| 4,252,605 | 2/1981 | Schaffer et al. | 376/125 |
| 4,474,113 | 10/1984 | Kyrö et al. | 102/306 |
| 4,481,886 | 11/1984 | Brattström et al. | 102/476 |
| 4,590,842 | 5/1986 | Goldstein et al. | 376/125 X |
| 4,596,030 | 6/1986 | Herziger et al. | 378/119 |
| 4,663,567 | 5/1987 | Wong | 315/111.21 |

*Primary Examiner*—Eugene R. LaRoche
*Assistant Examiner*—Seung Ham
*Attorney, Agent, or Firm*—Gary C. Roth; L. E. Carnahan; Judson R. Hightower

[57] ABSTRACT

A method and apparatus (10, 40) for producing high-velocity material jets is provided. An electric current pulse generator (14, 42) is attached to an end of a coaxial two-conductor transmission line (16, 44) having an outer cylindrical conductor (18), an inner cylindrical conductor (20), and a solid plastic or ceramic insulator (21) therebetween. A coxial, thin-walled metal structure (22, 30) is conductively joined to the two conductors (18, 20) of the transmission line (16, 44). An electrical current pulse applies magnetic pressure to and possibly explosively vaporizes metal structure (22), thereby collapsing it and impelling the extruded ejection of a high-velocity material jet therefrom. The jet is comprised of the metal of the structure (22), together with the material that comprises any covering layers (32, 34) disposed on the structure. An electric current pulse generator of the explosively driven magnetic flux compression type or variety (42) may be advantageously used in the practice of this invention.

10 Claims, 1 Drawing Sheet

ELECTRICAL METHOD AND APPARATUS FOR IMPELLING THE EXTRUDED EJECTION OF HIGH-VELOCITY MATERIAL JETS

The U.S. Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to a novel method and apparatus for impelling the extruded ejection of high-velocity material jets. While somewhat analogous in its function to the well-known and explosively driven shaped charge, the present invention is electrically driven.

In its basic configuration, a shaped charge is comprised of an explosive within which is disposed a cavity that is lined with metal. Detonation of the explosive collapses the metal upon its axis, thereby ejecting a metal jet. The metal jet produced by a shaped charge is of particular importance because of its ability to penetrate a variety of structural materials including armor. When used for this purpose, shaped charge metal jets typically have a velocity of about 5 to 10 millimeters per microsecond. The ability of a shaped charge metal jet to pierce protective armor coverings is most frequently increased by increasing the velocity of the jet.

In addition to shaped charges, there are many other known means for accelerating mass. For example, Janes et al in U.S. Pat. No. 3,256,687 issued June 21, 1966 disclose apparatus comprising a pair of spaced, concentric, cylindrical electrodes wherein a gaseous medium introduced between the electrodes is caused to become an electrically conductive ionized plasma and thereby establish a radial current path between the electrodes. Current flow through the plasma produces a magnetic field that accelerates the ionized plasma through an associated annulus, thereby causing a shock wave. Ionized particles and gas atoms compressed behind the shock wave cause temperature and velocity affects that result in a momentum change that imparts useful thrust to the device.

In an invention by Cheng, disclosed in U.S. Pat. No. 3,579,028 issued May 18, 1971, controlled amounts of pressurized gas are injected into a converging coaxial accelerator electrode configuration to achieve acceleration by deflagration and shaped electromagnetic field focusing. Resulting plasma is accelerated and focused to a decreasing cross section to provide dense plasma bursts for causing nuclear fusion reactions.

In Fletcher et al, U.S. Pat. No. 3,854,097 issued Dec. 10, 1974, apparatus is disclosed for compressing plasma discharged from a coaxial generator that includes a helically shaped tapered coil that is coaxially aligned with the generator. A current through the helical coil generates a time varying magnetic field that creates a radial force on the plasma. The plasma moves under high pressure and temperature to the narrow end of the coil where beads are engaged and accelerated to hypervelocities.

Schaffer in U.S. Pat. No. 4,252,605 issued Feb. 24, 1981 teaches trapping a magnetic flux in a rotating and electrically conductive liquid liner that is magnetically forced to implode by rotational energy derived from the liner. Upon expansion or rebound of the liner, rotational energy is recovered from the system.

Bohachevsky in U.S. Pat. No. 4,277,305 issued July 7, 1981 discloses discharging a capacitor bank to generate a cylindrical plasma sheath within a theta-pinch coil, and thereby heat the outer layer of a fuel element, and thus form a plasma layer thereupon. A high power photon, electron or ion beam deposites energy in either the sheath or the layer to assist in imploding the fuel element.

Kyro et al in U.S. Pat. No. 4,474,113 issued Oct. 2, 1984 provide a directed explosion effect hollow charge that comprises a mantle of the charge portion, an explosive material, a detonator, and a metal cone. The hollow charge is particularly well suited to open blocked or vaulted mine shafts.

Brattstrom et al in U.S. Pat. No. 4,481,886 issued Nov. 13, 1984 teach hollow charges and ammunition units that individually comprise a body of explosive material and an inner jet-forming cone member, together with an enclosing outer casing.

Goldstein et al in U.S. Pat. No. 4,590,842 issued May 27, 1986 disclose accelerating a projectile by supplying a pulsed high pressure and high velocity plasma jet to the rear of the projectile. The pulsed jet is derived from a dielectric capillary tube having an interior wall from which plasma forming material is ablated in response to a discharge voltage.

Herziger et al in U.S. Pat. No. 4,596,030 issued June 17, 1986 teach apparatus, for generating a plasma, that comprises concentric cylindrical electrodes that define a gas-filled discharge space. The plasma moves with high velocity towards an open end of the discharge space, and is compressed by magnetic fields at the end of an inner electrode.

Wong in U.S. Pat. No. 4,663,567 issued May 5, 1987 teaches creating first hollow and second solid coaxial cylinders of gas and then applying a high voltage, high current pulse along the common axis of the hollow and solid gaseous cylinders to cause them to implode on axis and produce a plasma.

Nevertheless, in spite of the many improvements that have been made to explosive shaped charges, and the many means that have been developed for accelerating mass, there remains a continuing need for a novel method and apparatus for impelling the extruded ejection of high-velocity material jets, particularly for purposes related to armor penetration. It would be particularly beneficial if such novel method and apparatus could provide material jets that travel at velocities in excess of the velocities of the jets provided by explosively driven shaped charges.

SUMMARY OF THE INVENTION

It is, therefore, an object of the invention to provide a method and apparatus for impelling the extruded ejection of high-velocity material jets.

Another object of the invention is to provide a method and apparatus for impelling the extruded ejection of material jets at velocities in excess of the velocities of the jets provided by explosively driven shaped charges.

Yet another object of the invention is to provide a non-explosively driven method and apparatus for impelling the extruded ejection of high-velocity material jets.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, a method and apparatus are provided for producing a high-velocity material jet. One end of a coaxial two-conductor transmission line, that comprises an outer cylindrical conductor, an inner cylindrical conductor that has a common central axis therewith, and a solid plastic or ceramic insulator that completely fills the space between the two conductors, is adapted to receive an electric current pulse. The electric current pulse may be supplied by an external source, or, as is frequently preferred, the pulse may be supplied by a means that is incorporated within the material jet producing apparatus itself. It is sometimes preferred that the electric current pulse be provided by an electric current pulse generator of the explosively driven magnetic flux compression type or variety. At the other end of the transmission line, the outer and inner cylindrical conductors are conductively joined by a thin-walled metal structure that is also attached or bonded to the solid plastic or ceramic insulator. This structure is axisymmetric with respect to the coaxial transmission line, and has an internal cavity that opens inwardly toward the interior of the transmission line. In operation, the electric current pulse flows through the transmission line and the thin-walled metal structure system. The polarity of the electric current pulse is not critical to the performance of this invention. When the electric current pulse flows, it produces a very high magnetic pressure that causes the thin-walled structure to collapse upon its internal cavity. Additionally, electric current flow very often explosively vaporizes all or part of the metal structure and thereby imparts an intense, inward, radial push to the structure that also contributes to the implosive collapse of the cavity. The force of the collapse impells the extruded ejection of a high velocity material jet from the throat region of the collapsed metal structure. In this situation, the material jet is comprised of a portion of the metal that had originally comprised the thin-walled metal structure.

In the practice of the method and apparatus of this invention, it is frequently preferred to dispose a first covering layer, comprised of an insulator, on or over the inner surface of the cavity of the thin-walled metal structure. When this is done, the high-velocity material jet, in addition to being comprised of a portion of the metal of the structure, will be also comprised of at least a part of the insulator that comprised the first covering layer. It is additionally frequently preferred to position a second covering layer, comprised of a material capable of conducting electricity, on or over the first covering layer. In this situation the high-velocity material jet will be further comprised of a part of the material capable of conducting electricity that comprises the second covering layer.

The benefits and advantages of the present invention, as embodied and broadly described herein, include, inter alia, the provision of a novel electrically driven method and apparatus for impelling the extruded ejection of material jets at velocities in excess of the velocities of the jets produced by explosively driven shaped charges.

BRIEF DESCRIPTION OF THE DRAWINGS

The accompanying drawings, which are incorporated into and form a part of the specification, illustrate an embodiment of the invention and, together with the description, serve to explain the principles of the invention. In the drawings.

DETAILED DESCRIPTION OF THE INVENTION

Figure 1:
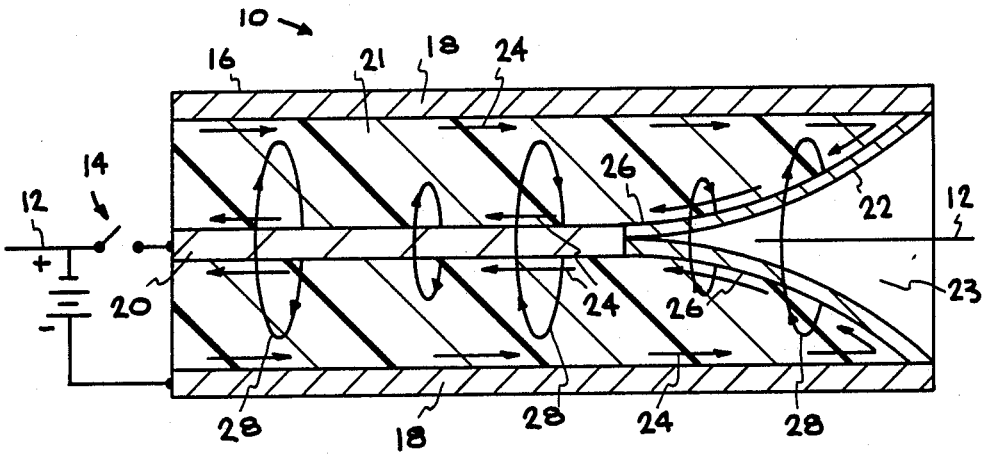
FIG. 1 is a cross-sectional side view of an axisymmetric apparatus for producing a high-velocity material jet, in accordance with the invention.

Reference will now be made in detail to the present preferred embodiment of the invention, an example of which is illustrated in the accompanying drawings. FIG. 1 shows a cross-sectional side view of an apparatus 10, in accordance with the invention, for producing a high-velocity material jet. Apparatus 10 is axisymmetric with respect to an axis 12. The apparatus 10 is driven by an electric current pulse that is externally supplied by an electric current pulse generator 14 which is very schematically indicated. Electric current pulse generators are very well known in the electronic and electronically related arts. Pulse generator 14 may be of any type, however, it is sometimes preferred that generator 14 be of the explosively driven magnetic flux compression type, as generally described in the publication "Megagauss Technology and Pulse Power Applications, Proceedings of the Megagauss IV Conference", edited by C. M. Fowler et al, Plenum Press (1987), which publication is incorporated by reference herein. In use, the electric current pulse produced by pulse generator 14 is adaptively received into the end of a coaxial two-conductor transmission line 16, as schematically shown. Means for introducing an electric current pulse into an end of a coaxial two-conductor transmission line are very well known in the electronic and electronically related arts. Transmission line 16 is comprised of an outer cylindrical conductor 18 that is enclosingly disposed about an inner cylindrical conductor 20, as shown. Transmission line 16 is also comprised of a solid plastic or ceramic insulator 21 that completely fills the space between conductors 18 and 20, as shown. A purpose of solid insulator 21 is to prevent electrical arcing between conductors 18 and 20, consequently solid insulator 21 may not be comprised of any foam or foam-like material.

Conductors 18 and 20 are conductively joined by a thin-walled metal structure 22, as shown. Structure 22 is located at the opposite end of coaxial transmission line 16 from the end of line 16 into which the electric current pulse produced by generator 14 is introduced. Metal structure 22 is attached or bonded to solid ceramic or plastic insulator 21, for example by gluing or by directly vapor depositing structure 22 upon insulator 21. Structure 22 and the coaxial transmission line 16 are each axisymmetric with respect to axis 12, as shown. Additionally, metal structure 22 has an internal cavity 23 that opens inwardly, i.e. toward the left in FIG. 1, toward the interior of coaxial transmission line 16. Thin-walled structure 22 is very schematically represented and, in practice, may be configured as a hollow cone, a hollow hemisphere, a hollow taper, or any other axi-symmetric thin-walled shape having an internal cavity.

As indicated by a plurality of circulating arrows 24, when electric current pulse generator 14 produces an electric current pulse, the pulse generally flows through an outer skin layer of inner cylindrical conductor 20, an inner skin layer of outer cylindrical conductor 18, and an outer skin layer of the thin-walled metal structure 22. Arrows 24 are shown slightly spaced apart from the respective skin layers for reasons of clarity. As is very well known, however, the skin layer through which a pulse of electric current flows is a very thin surface layer that decreases in thickness as the temporal width of the electric current pulse decreases. The circulating electric current pulse, indicated by arrows 24, produces a high magnetic pressure adjacent to an outer surface 26 of the metal structure 22. The magnetic pressure is produced by a magnetic field that is circularly concentric around axis 12, and is represented by circular magnetic flux arrows 28, in the usual manner. Magnetic pressure is proportional to the square of the vale of the magnetic field. The high magnetic pressure adjacent to and acting upon outer surface 26 of metal structure 22, causes metal structure 22 to collapse upon internal cavity 23, and impells the extruded ejection of an axial high-velocity material jet from the collapsed structure 22. The resulting jet will be comprised of a part of the metal that had comprised structure 22. The circulating electric current pulse, indicated by arrows 24, additionally may sometimes explosively vaporize all or part of structure 22, and thereby impart an intense, inward radial push to structure 22, and thus also contribute to the collapse of internal cavity 23. Being electrically driven, the manner of the implosive collapse of cavity 23 of metal structure 22 is only limited by the inherent rise time of the current pulse produced by generator 14 and by the time it takes for that electrical signal to travel, and effective implosive phase velocities approaching the speed of light may be achieved. This is true both if the collapse is entirely driven by magnetic pressure, or by a combination of magnetic pressure and explosive vaporization. During the process of its collapse, solid plastic or ceramic insulator 21 provides an inertial backup for metal structure 22. Solid insulator 21 also aids in keeping inner and outer cylindrical conductors 18 and 20 relatively stationary and intact as metal structure 22 collapses and extrudes a high-velocity material jet. The velocities of the material jets produced by the method and apparatus of this invention are not limited by the detonation properties of chemical high-explosives.

Figure 2:
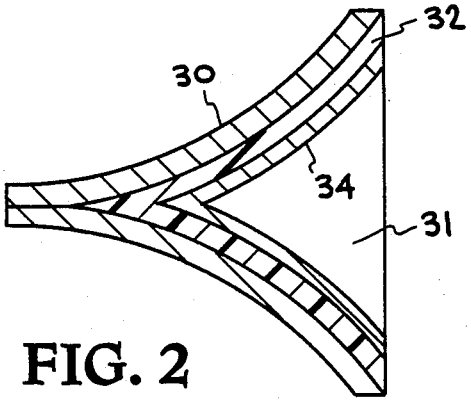
FIG. 2 is a cross-sectional side view of a thin-walled metal structure having a cavity, together with a first and a second covering layer upon the cavity, in accordance with the invention.

Reference is now made to FIG. 2 which provides a cross-sectional side view of a thin-walled metal structure 30 that has a cavity 31. Structure 30 is exactly the same as structure 22, as described above. It is frequently preferred to dispose a first covering layer 32, comprised of an insulator, on an inner surface of cavity 31 of metal structure 30, as shown. When this is done and items 30 and 32 are incorporated into apparatus such as apparatus 10 of FIG. 1, high-velocity material jets comprised of the materials of items 30 and 32 may be provided by the method and apparatus of this invention as metal structure 30 is caused to implosively collapse. Insulating covering layer 32 also provides the advantage of preventing electrical arcing across the interior of cavity 31. Similarly, it is often further preferred to position a second covering layer 34, comprised of a material capable of conducting electricity, on or over first covering layer 32, as shown. When this is done and items 30, 32 and 34 are incorporated into apparatus such as apparatus 10 of FIG. 1, high-velocity material jets comprised of the materials of items 30, 32 and 34 may be provided by the method and apparatus of this invention as metal structure 30 is caused to implosively collapse. First covering layer 32, being an insulator, prevents electric current from flowing or arcing to the conductive material that comprises the second covering layer 34. Extraneous current flow of this nature could possibly prevent the apparatus of this invention from operating efficiently.

Figure 3:
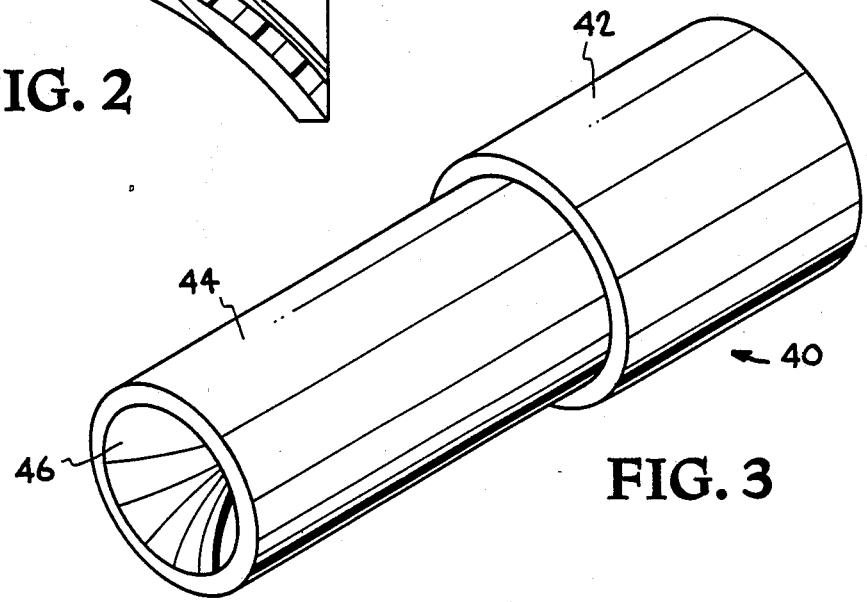
FIG. 3 is a perspective view of an apparatus for producing a high-velocity material jet, in accordance with the invention.

Reference is now made to FIG. 3 which shows a perspective view of the exterior of an apparatus 40, in accordance with the invention, for producing a high-velocity material jet. Apparatus 40 directly incorporates an electric current pulse generator 42, that is of the explosively driven magnetic flux compression type or variety, into structure as shown and described above with respect to FIG. 1. A coaxial transmission line 44 extends outward from pulse generator 42, and an inner surface of a thin-walled metal structure 46 is shown positioned at the forward end of transmission line 44. The purpose of FIG. 3 is to show that apparatus 40 is very compact and may be conveniently positioned adjacent to structural materials, including armor, and conveniently used for the penetration thereof.

It is thus appreciated that in accordance with the invention as herein described and shown in FIGS. 1 to 3, a novel electrically driven method and apparatus are provided for impelling the extruded ejection of material jets at velocities in excess of the velocities of the jets produced by explosively driven shaped charges.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for producing a high-velocity material jet, the apparatus adapted to be driven by an externally supplied electric current pulse, said apparatus comprising:

a coaxial two-conductor transmission line that comprises an outer cylindrical conductor, an inner cylindrical conductor that has a common central axis therewith, and a solid plastic or ceramic insulator that completely fills the space between the inner cylindrical conductor and the outer cylindrical conductor, with the transmission line having a first end and a second end, and with the outer cylindrical conductor and the inner cylindrical conductor at the first end of the transmission line adapted to receive the externally supplied electric current pulse; and a thin-walled metal structure attached or bonded to the solid plastic or ceramic insulator and conductively joining the outer conductor to the inner conductor at the second end of the transmission line, with the metal structure axisymmetric with respect to the common central axis and having a cavity that opens inwardly toward the interior of the transmission line;

whereby, when the externally supplied electric current pulse is received at the first end of the transmission line the metal structure collapses upon the cavity and impells the extruded ejection therefrom of said high-velocity material jet, with the jet comprised of a part of the metal that comprises the metal structure.

2. An apparatus for producing a high-velocity material jet, as recited in claim 1, further comprising:

a first covering layer, comprised of an insulator, disposed on an inner surface of the cavity of the thin-walled metal structure;

whereby, said high-velocity material jet is comprised of both a part of the metal that comprises the metal structure and a portion of the insulator that comprises the first covering layer.

3. An apparatus for producing a high-velocity material jet, as recited in claim 2, further comprising:

a second covering layer, comprised of a material capable of conducting electricity, disposed on the first covering layer;

whereby, said high-velocity material jet is comprised of a part of the metal that comprises the metal structure, a portion of the insulator that comprises the first covering layer, and a portion of the material capable of conducting electricity that comprises the second covering layer.

4. An apparatus for producing a high-velocity material jet, said apparatus comprising:

means for supplying an electric current pulse;

a coaxial two-conductor transmission line that comprises an outer cylindrical conductor, an inner cylindrical conductor that has a common central axis therewith, and a solid plastic or ceramic insulator that completely fills the space between the inner cylindrical conductor and the outer cylindrical conductor, with the transmission line having a first end and a second end, and with the outer cylindrical conductor and the inner cylindrical conductor at the first end of the transmission line adapted to receive the electric current pulse; and a thin-walled metal structure attached or bonded to the solid plastic or ceramic insulator and conductively joining the outer conductor to the inner conductor at the second end of the transmission line, with the metal structure axisymmetric with respect to the common central axis and having a cavity that opens inwardly toward the interior of the transmission line;

whereby, when the electric current pulse is received at the first end of the transmission line, the metal structure collapses upon the cavity and impells the extruded ejection therefrom of said high-velocity material jet, with the jet comprised of a part of the metal that comprises th metal structure.

5. An apparatus for producing a high-velocity material jet, as recited in claim 4, further comprising:

a first covering layer, comprised of an insulator, disposed on an inner surface of the cavity of the thin-walled metal structure;

whereby, said high-velocity material jet is comprised of both a part of the metal that comprises the metal structure and a portion of the insulator that comprises the first covering layer.

6. An apparatus for producing a high-velocity material jet, as recited in claim 5, further comprising:

a second covering layer, comprised of a material capable of conducting electricity, disposed on the first covering layer;

whereby, said high-velocity material jet is comprised of a part of the metal that comprises the metal structure, a portion of the insulator that comprises the first covering layer, and a portion of the material capable of conducting electricity that comprises the second covering layer.

7. An apparatus for producing a high-velocity material jet, as recited in claim 4, wherein the means for supplying an electric current pulse comprises an electric current pulse generator of the explosively driven magnetic flux compression variety.

8. A method for producing a high-velocity material jet, the method comprising the step of:

supplying an electric current pulse into a first end of a coaxial two-conductor transmission line that comprises an outer cylindrical conductor, an inner cylindrical conductor that has a common central axis therewith, and a solid plastic or ceramic insulator that completely fills the space between the inner cylindrical conductor and the outer cylindrical conductor, with the outer cylindrical conductor and the inner cylindrical conductor, at a second end of the coaxial two-conductor transmission line, conductively joined by a thin-walled metal structure that is also attached or bonded to the solid plastic or ceramic insulator, and with the metal structure axisymmetric with respect to the common central axis and having a cavity that opens inwardly toward the interior of the transmission line;

whereby, the electric current pulse collapses the metal structure upon the cavity and impells the extruded ejection therefrom of said high-velocity material jet, with the jet comprised of a part of the metal that comprises the metal structure.

9. A method for producing a high-velocity material jet, as recited in claim 8, further comprising, before the supplying step, the step of disposing a first covering layer, comprised of an insulator, on an inner surface of the cavity of the thin-walled metal structure, so that the high-velocity material jet is further comprised of a portion of the insulator that comprises the first covering layer.

10. A method for producing a high-velocity material jet, as recited in claim 9, further comprising, after the disposing step and before the supplying step, the step of positioning a second covering layer, comprised of a material capable of conducting electricity, on the first covering layer, so that the high-velocity material jet is further comprised of a portion of the material capable of conducting electricity that comprises the second covering layer.

* * * * *